US011399680B2

(12) United States Patent
Hunnekuhl

(10) Patent No.: US 11,399,680 B2
(45) Date of Patent: Aug. 2, 2022

(54) HAND-GUIDED CYCLONE VACUUM CLEANER

(71) Applicant: Miele & Cie. KG, Guetersloh (DE)

(72) Inventor: Christian Hunnekuhl, Wallenhorst (DE)

(73) Assignee: Miele & Cie. KG, Guetersloh (DE)

( * ) Notice: Subject to any disclaimer, the term of this patent is extended or adjusted under 35 U.S.C. 154(b) by 317 days.

(21) Appl. No.: 16/744,225

(22) Filed: Jan. 16, 2020

(65) Prior Publication Data

US 2020/0253442 A1 Aug. 13, 2020

(30) Foreign Application Priority Data

Feb. 7, 2019 (DE) ..... 10 2019 103 019.6

(51) Int. Cl.
*A47L 9/16* (2006.01)
*A47L 9/14* (2006.01)

(52) U.S. Cl.
CPC ..... *A47L 9/1691* (2013.01); *A47L 9/1409* (2013.01)

(58) Field of Classification Search
CPC ..... A47L 9/1691; A47L 9/1409
See application file for complete search history.

(56) References Cited

U.S. PATENT DOCUMENTS 3,621,640 A * 11/1971 Ohno et al. ..... A47L 9/1409 55/300
7,134,165 B2 * 11/2006 Pullins ..... A47L 9/122 15/352
2010/0229335 A1 9/2010 Conrad
2017/0290477 A1 * 10/2017 Conrad ..... A47L 9/1666

* cited by examiner

*Primary Examiner* — Anne M Kozak
*Assistant Examiner* — Bobby Lee Budziszek
(74) *Attorney, Agent, or Firm* — Leydig, Voit & Mayer, Ltd.

(57) ABSTRACT

A hand-guide cyclone vacuum cleaner includes: a device body which has a drive unit for generating a suction air flow; a suction container, which is connected to the device body, for receiving suction material; and an operating element arranged at one end of the suction container opposite an end of the suction container on which the device body is arranged. The operating element is rotatable from a first position into a second position and from the second position into the first position. The device body is inseparably connected to the suction container in the first position. The device body is separably connected to the suction container in the second position.

9 Claims, 7 Drawing Sheets

HAND-GUIDED CYCLONE VACUUM CLEANER

CROSS-REFERENCE TO PRIOR APPLICATION

Priority is claimed to German Patent Application No. DE 10 2019 103 019.6 filed on Feb. 7, 2019, the entire disclosure of which is hereby incorporated by reference herein.

FIELD

The invention relates to a hand-guided cyclone vacuum cleaner which is also referred to hereinafter as a vacuum cleaner for the sake of simplicity. In particular, the invention relates to a vacuum cleaner which has a removable suction container which is designed to collect suction material.

BACKGROUND

In prior vacuum cleaners, the removal and operation of the suction container is complicated for a user.

SUMMARY

In an embodiment, the present invention provides a hand-guide cyclone vacuum cleaner, comprising: a device body which has a drive unit configured to generate a suction air flow; a suction container, which is connected to the device body, configured to receive suction material; and an operating element arranged at one end of the suction container opposite an end of the suction container on which the device body is arranged, wherein the operating element is rotatable from a first position into a second position and from the second position into the first position, wherein the device body is inseparably connected to the suction container in the first position, and wherein the device body is separably connected to the suction container in the second position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
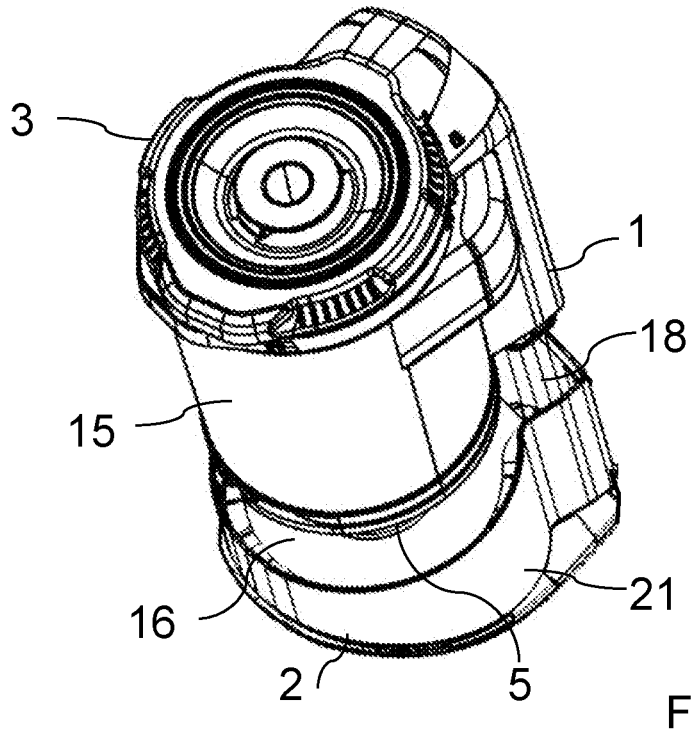
FIG. 1 a partial perspective view of a vacuum cleaner according to the invention.

Thus, the invention is faced with the problem of providing a hand-guided cyclone vacuum cleaner in which the removal and operation of the suction container are easy.

Apart from the easy manageability of the suction container of the vacuum cleaner, advantages achievable with the invention consist of the fact that the removal and emptying can be carried out by means of a single operating element. This makes it possible for the user to carry out all relevant handling steps via an intuitively operable rotary element. The rotatable operating element can be integrated well into a design of the vacuum cleaner, wherein design freedom is achieved.

In an embodiment, the present invention provides a hand-guided cyclone vacuum cleaner, comprising a device body which has a drive unit which is designed to generate a suction air flow, a suction container, connected to the device body, for receiving suction material, an operating element arranged at one end of the suction container opposite the end of the suction container on which the device body is arranged, wherein the operating element is rotatable from a first position into a second position and vice versa, wherein the device body is inseparably connected to the suction container in the first position and wherein the device body is separably connected to the suction container in the second position.

The term "hand-guided" is to be understood to mean that the vacuum cleaner is guided by hand by the user during operation. For this purpose, the vacuum cleaner preferably further has a handle which can be connected to the suction container and is connected thereto during operation. Furthermore, the vacuum cleaner can have a suction pipe which can be connected to the suction container and/or the device body and, when in operation, is connected to one of them as needed.

The term "cyclone vacuum cleaner" is to be understood as meaning a vacuum cleaner which is bag-free and in which vortices and any turbulence are generated in a flow of air entering the vacuum cleaner, as a result of which the suction material, such as dust particles, are pressed and deposited in a predetermined direction due to centrifugal force. The term "bag-free" is to be understood to mean that the suction material in the vacuum cleaner is collected directly in the suction container without a bag or similar throw-away filter medium for receiving suction material being arranged therein, so that the user does not remove any bag or the like from the suction container in order to empty the suction material from the suction container. However, the vacuum cleaner may have one or more filter media which prevent sucked-up suction material from entering the drive unit arranged in the device body. Both the suction container and the device body are preferably made of plastic.

The vacuum cleaner is preferably a battery-operated vacuum cleaner. In other words, the vacuum cleaner has a battery and is designed to be operated by means of the battery as the current source. The battery can be connected to the suction container and/or the device body, preferably to the device body.

The suction container is preferably guided on the device body in a positive-locking manner. This ensures that it does not twist on the device body when the operating element is rotated. The operating element is preferably integrated into the suction container. The suction container and the device body are preferably designed such that they can only be separated in the second position; that is to say, they cannot be separated in a position other than the second position if they are to be connected.

The expression "inseparably connected" is to be understood to mean that the suction container and the device body are not separable by pulling them apart. The expression "separably connected" is to be understood to mean that the suction container and the device body can be separated by pulling them apart.

In an operative working position, the suction container is located at a rear side or rear end of the vacuum cleaner, which means that it is closer to the user's hand and further away from the surface to be vacuumed than the device body. The operating element is thus easy to handle.

In a preferred embodiment, the device body has a base plate and a connecting piece which extends away from the base plate and has a latching cam, and the suction container has a pre-filter with a locking geometry which is designed in such a way that it holds the latching cam in the first position of the operating element and releases it in the second position of the operating element, so that the device body is non-removably connected to the suction container in the first position of the operating element and is removably connected to the suction container in the second position.

In a preferred embodiment, the suction container has a housing and a pre-filter with a sleeve-like part which is arranged in the housing, wherein one end of the housing and one end of a wall of the device body extending away from the base plate have a complementary contour and the sleeve-like part can be placed onto the connecting piece. The suction container and the device body can thereby be connected to one another.

The connecting piece preferably has a plurality of latching cams and the pre-filter has a plurality of locking geometries which are each formed and designed to receive a respective latching cam, wherein each locking geometry has a slot which is open in the direction toward the base plate when the suction container is placed onto the device body, as well as a locking part which extends away from the respective slot and is closed in the direction toward the base plate and extends angularly away from the respective slot in the direction opposite to the base plate. The latching cams are preferably distributed uniformly around the circumference of the connecting piece, and the locking geometries are preferably distributed uniformly around the circumference of the sleeve-like part of the pre-filter.

Each slot of each locking geometry is preferably designed to allow a latching cam of the connecting piece to be inserted at least partially into the sleeve-like part of the pre-filter when the suction container is placed onto the device body. As a result, the suction container can be placed onto the device body without any additional exertion of force. The path for placement is limited by a stop of the respective slot. Each locking geometry preferably has a geometry such that the suction container can be placed in a predetermined position. This encodes the system.

The latching cams and the locking geometries are preferably designed in such a way that the latching cams are arranged in the respectively associated locking part if the operating element is in the first position and that the latching cams are arranged in the respectively associated slot if the operating element is in the second position. The latching cams are preferably designed such that they are guided into the slots or locking parts by rotating the operating element if the operating element is rotated from the first into the second position and vice versa. As a result, the device body and the suction container in the first position cannot be separated by pulling them apart or away from one another and can be separated in the second position by pulling them apart. In a preferred embodiment, the slots are arranged helically, as a result of which the suction container is easily lifted off the device body when the operating element is moved into a second position.

The suction container preferably has the housing, the pre-filter arranged in the housing, a central filter arranged in the pre-filter, and a flap which is arranged at the end of the suction container on which the device body is arranged. Preferably, the operating element is further rotatable into a third, fourth and/or fifth position and vice versa, wherein the flap can be opened in the third position, the central filter can be removed in the fourth position from the pre-filter and thus from the housing, and the pre-filter can be removed from the housing in the fifth position. As a result, removal, emptying and service can furthermore be carried out by means of a single operating element.

The operating element is preferably designed to be rotatable into the third, fourth and fifth positions and vice versa. Preferably, the operating element is designed such that it can be rotated from the first into the second, from the second into the third, from the third into the fourth and from the fourth into the fifth position, and vice versa.

Preferably, the flap is openable only in the third position; that is to say, it is designed to not be openable in a position other than the third position. The central filter can preferably be removed from the pre-filter only in the fourth position; that is to say, it is designed to not be removable from the pre-filter in a position other than the fourth position. Preferably, the pre-filter can be removed from the housing only in the fifth position; that is to say, it is designed to not be removable from the housing in a position other than the fifth position.

Preferably, the suction container is designed in such a way that the user touches uncontaminated areas of the central filter and of the pre-filter in order to remove the central filter and/or the pre-filter. This is realized in that the area of the central filter and pre-filter to be gripped by the user for removal is preferably not arranged in a separator chamber in which particles are deposited from a suction stream during operation. That is to say, they are not located in a suction collection chamber in which the suction material is collected during operation.

In the second position, the latching cam of the connecting piece is preferably arranged adjacent to a stop of the locking geometry so that, when the operating element rotates from the first position into the second position, the further rotation of the operating element beyond the second position into the third position is prevented as long as the suction container is arranged on the device body. This ensures that the flap can only be opened if the device body is separated from the suction container.

In a preferred embodiment, the flap has a flap latching cam which engages in the locking geometries of the pre-filter in the second position of the operating element and which is designed such that it lies above a recess in the locking geometry of the pre-filter when the suction container is separated from the device body and the operating element is rotated into the third position, so that the flap can be opened. This ensures that the flap is tightly connected to the pre-filter during operation of the vacuum cleaner. The flap can preferably be opened by pivoting or flapping. The flap preferably has a plurality of flap latching cams, each of which engages in one of the plurality of locking geometries of the pre-filter in the second position of the operating element. The flap latching cams are preferably arranged to be uniformly distributed around a circumference of the flap. The flaps are preferably arranged centrally on the flap. Due to the fact that a locking of the flap is embodied centrally and distributed around the circumference, a further optimized pressing of the flap onto the pre-filter and the housing is provided.

Preferably, the suction container furthermore comprises a spring which is designed to pivot the flap away from the housing and the pre-filter in the third position of the operating element. The opening of the flap for emptying the suction container is thereby automated. The spring is preferably connected to the pre-filter and the flap. The spring is preferably connected to the pre-filter via a bellows, which furthermore supports a movement of an exhaust-air duct formed by means of a separating plate in the direction out of the suction container when the flap is opened, wherein the separating plate separates the exhaust-air duct from the suction collection chamber in a radial direction.

In a preferred embodiment, the suction container furthermore comprises a latching hook which is arranged on the pre-filter and which holds the central filter in the pre-filter and which is designed such that it is free of force in an operating state and is released for a spring travel after the operating element is rotated into the fourth position, so that the central filter can be removed from the pre-filter. This ensures that the central filter can be removed from the pre-filter as needed, for example for cleaning, but is otherwise fixedly connected to the pre-filter.

The pre-filter preferably has at least three transverse ribs and the operating element has a centering ring with grooves in which the transverse ribs run. The grooves are preferably designed in such a way that they each have an opening in the fifth position, so that the pre-filter and the operating element can be removed perpendicularly to the axis of rotation of the operating element. The grooves are preferably embodied in such a way that, when the pre-filter moves between the third and fifth positions, the pre-filter lifts away from the central filter. Optimal access to all components can thereby be ensured in a service event. The transverse ribs are preferably arranged and distributed over the circumference of the pre-filter. They serve as guide elements during a rotation operation of the operating element. In an alternative embodiment, the pre-filter has at least three pins and the operating element has a centering ring with grooves in which the pins run. If the central filter is arranged in the pre-filter in the fifth position of the operating element, it can be removed together with the pre-filter and the operating element in the fifth position. However, the central filter can also already have been removed from the pre-filter in the fourth position of the operating element. Whether or not the central filter is located in the pre-filter is insignificant in the fifth position.

Preferably, the suction container is designed in such a way that the operating element and the pre-filter are only partially removable in the fifth position and can be removed completely from the housing only after the operating element has been rotated into a sixth position, which lies between the fourth and fifth positions, and is subsequently rotated again into the fifth position. This is advantageous because the user can only intentionally remove the operating element and the pre-filter by intentionally rotating the operating element from the fifth position into the sixth position in the direction of the fourth position and then into the fifth position. This ensures that the user does not suddenly hold the pre-filter in his hand while the housing falls down as a result of the separation from the pre-filter. The expression "partially removable" is to be understood to mean that the connection between the pre-filter and the housing is only partially and incompletely released.

The transverse ribs are preferably encoded. The transverse ribs are preferably arranged at an offset by a predetermined value and distributed over the circumference of the pre-filter, with the exception of one transverse rib which is arranged at an offset by a value other than the predetermined value. In the case of three transverse ribs, two transverse ribs are, for example, arranged at an offset by 120° and distributed over the circumference of the pre-filter, while the third transverse rib is arranged at an offset by a value other than 120°. This provides the encoding. The operating element preferably has latching points and entry guides which are correspondingly encoded. That is to say, they are preferably arranged at an offset by a predetermined value and distributed over the circumference of the operating element, with the exception of one latching point and one entry guide which are arranged at an offset by a value other than the predetermined value.

In a preferred embodiment, the centering ring has latching points which can be overcome by the transverse ribs upon rotation in order to get into the next position of the first, second, third, fourth and fifth positions during the rotation. This ensures proper positioning in the respective position.

Preferably, the operating element is designed to be rotated by 20-25° from the first into the second position, by 42-45° from the first into the third position, by 77-80° from the first into the fourth position, and by 88-90 from the first into the fifth position. The operating element is preferably designed such that it is rotated by 84-86° from the first into the sixth position.

The operating element is preferably designed such that, in order to open the suction container, it can be rotated from the first position into the second position, from the second position into the third position, from the third position into the fourth position and from the fourth position into the fifth position in the indicated sequence. This ensures that, when the pre-filter and/or the central filter is removed, the suction collection chamber is also emptied. In addition, this ensures that the central filter cannot be removed as long as the suction container is still in the device body or the suction container has not yet been emptied. This prevents dust or dirt particles from entering the intake area of the blower.

FIG. 1 shows a partial perspective view of a vacuum cleaner according to the invention. The vacuum cleaner has a device body 2 in which a drive unit is arranged. Furthermore, the vacuum cleaner has a suction container 1 with a housing 15 and an operating element 3. The suction container 1 can be connected at one end to the device body 2 and is connected to the operating element 3 with a further end which is opposite the end, which can be connected to the device body 2. The device body 2 comprises a base plate 16, a connecting piece 5 extending away from the base plate 16 and a wall 21 extending away from the base plate 16. Via the wall 21 and the connecting piece 5, the device body 2 can be connected to the suction container 1 which has a corresponding mating geometry. The device body 2 has a suction channel 18 through which a suction stream generated by means of the drive unit flows during operation.

The operating element 3 is designed to be rotatable from a first position into a second position and vice versa, wherein the device body 2 is inseparably connected to the suction container 1 in the first position and the device body 2 is separably connected to the suction container 1 in the second position. The operating element 3 shown in FIG. 1 is in the second position. The suction container 1 is shown by the device body 2 in FIG. 1 during a separation process, in which the suction container 1 and the device body 2 are separated from one another, so that the wall 21 is separated from the mating geometry of the suction container, but the connecting piece 5 is still partially connected to the mating geometry of the suction container 1.

Figure 2:
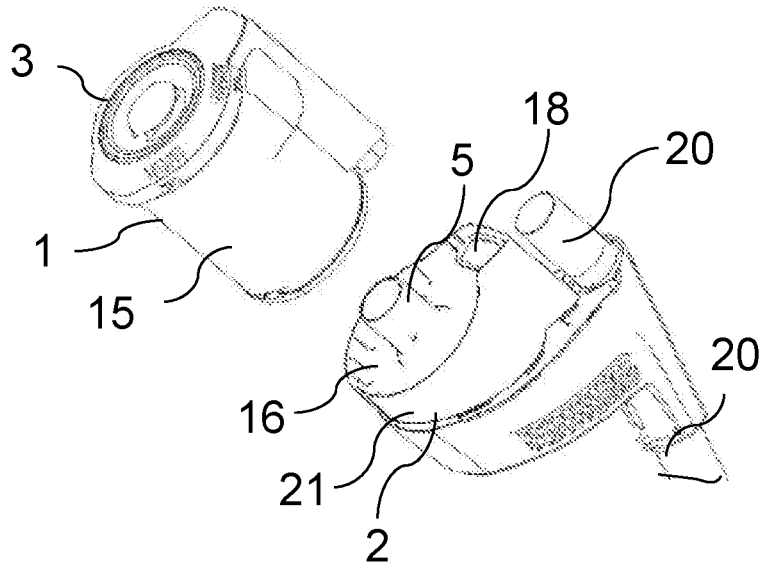
FIG. 2 a further partial perspective view of the vacuum cleaner shown in FIG. 1.

FIG. 2 shows a further partial perspective view of the vacuum cleaner shown in FIG. 1. The vacuum cleaner shown in FIG. 2 corresponds to the vacuum cleaner shown in FIG. 1, with the difference that the separation process has progressed further and the connecting piece 5 is now completely separated from the mating geometry of the suction container 1, so that two suction pipes 20 of the device body 2 are visible. The suction pipes 20 are designed to be connected to a handle and/or to a suction pipe.

Figure 3:
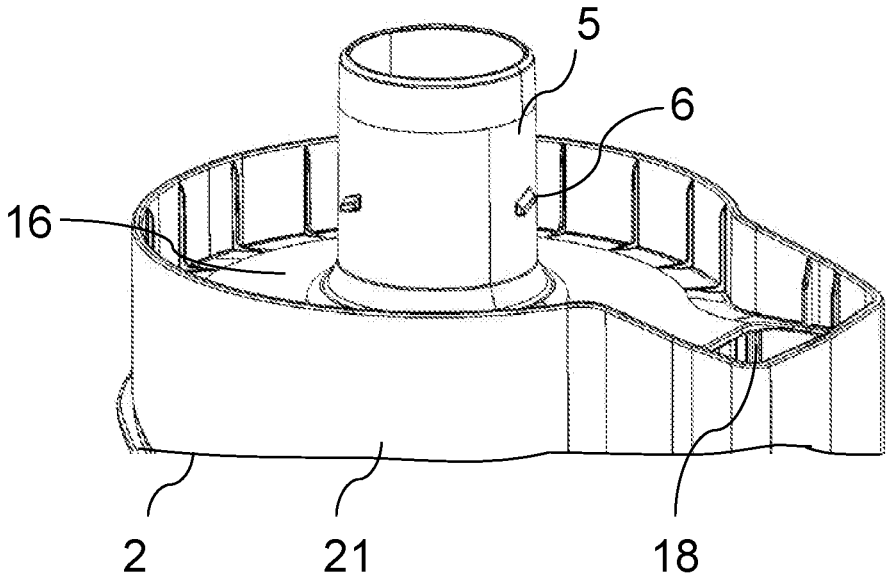
FIG. 3 a partial perspective view of the device body shown in FIG. 2.

FIG. 3 shows a partial perspective view of the device body shown in FIG. 2. The wall 21 and the connecting piece 5 extend in the same direction away from the base plate 16. The connecting piece 5 has a plurality of latching cams 6 distributed uniformly around its circumference. Purely by way of example, the connecting piece has three latching cams 6 of which two are visible in FIG. 3. The latching cams 6 are arranged on the connecting piece 5 obliquely with respect to the base plate 16 and are designed such that they can be inserted into a locking geometry of the suction container by a rotational movement.

Figure 4:
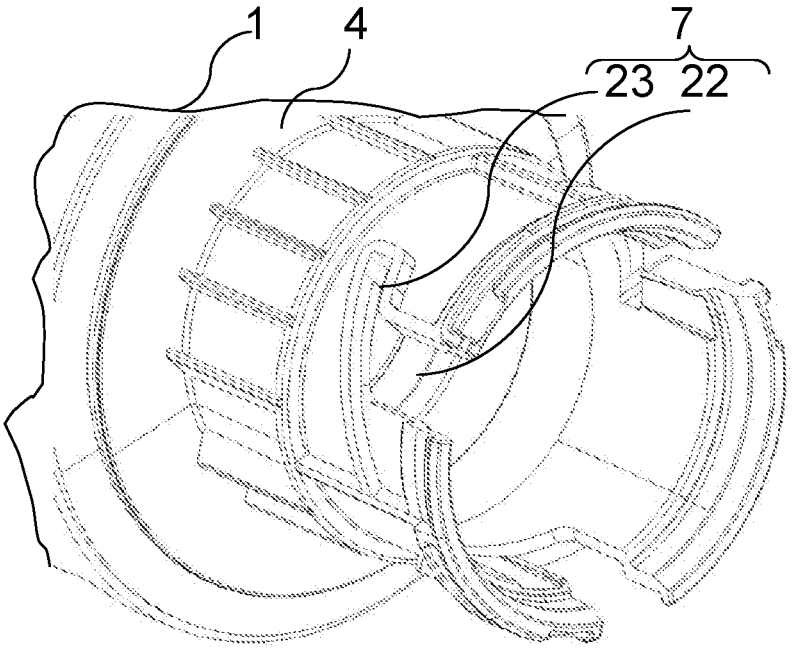
FIG. 4 a partial perspective view of the suction container shown in FIG. 2.

FIG. 4 shows a partial perspective view of the suction container shown in FIG. 2. The suction container 1 comprises the pre-filter 4, which has a sleeve-like part. The sleeve-like part of the pre-filter 4 has, purely by way of example, three locking geometries 7, each of which has a slot 22 and a locking part 23 and is distributed uniformly around the circumference of the sleeve-like part of the pre-filter 4, so that the latching cams shown in FIG. 3 can be inserted thereinto. If the latching cams shown in FIG. 3 are inserted into the respectively associated slot 22, the device body shown in FIG. 3 and the suction container 1 are separably connected because they can be released from one another by a pulling movement. In this case, the operating element shown in FIG. 2 is in the second position. If the latching cams shown in FIG. 3 are inserted into the respective associated locking part 23, the device body shown in FIG. 3 and the suction container 1 are latched to one another and cannot be released from one another by a pulling movement. In this case, the operating element shown in FIG. 2 is in the first position.

Figure 5:
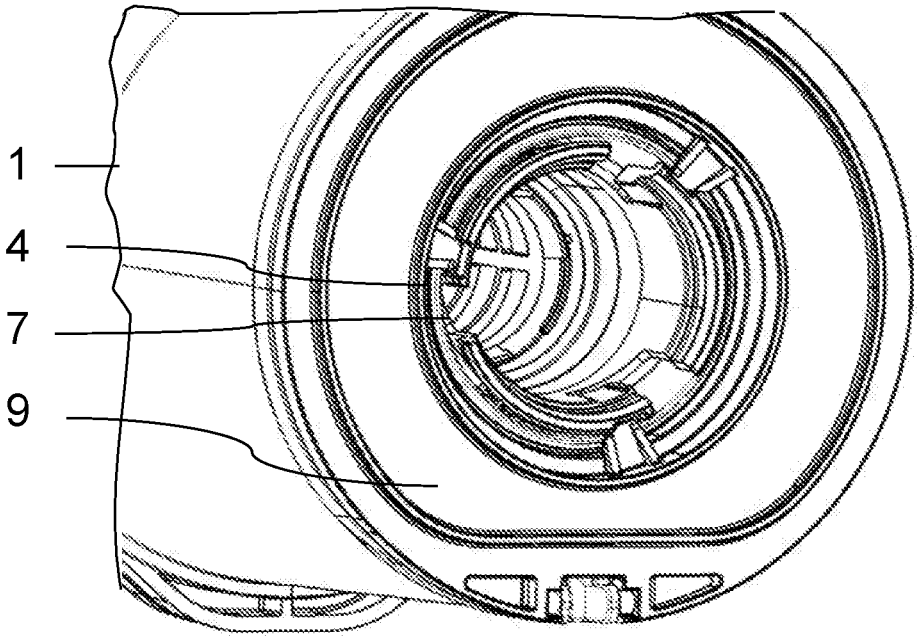
FIG. 5 a further partial perspective view of the suction container shown in FIG. 2.

FIG. 5 shows a further partial perspective view of the suction container shown in FIG. 2. The suction container 1 furthermore has a flap 9 which is arranged at the end of the suction container 1 which, when connected to the device body shown in FIG. 3, is arranged to be adjacent to the device body. The flap 9 is arranged around the pre-filter 4 so that it is arranged to be adjacent to the base plate of the device body shown in FIG. 3 if the suction container 1 is connected to the device body. In the second position, the flap 9 closes a suction collection chamber or area of the suction container in which sucked-up suction material, such as dust, is collected.

Figure 6:
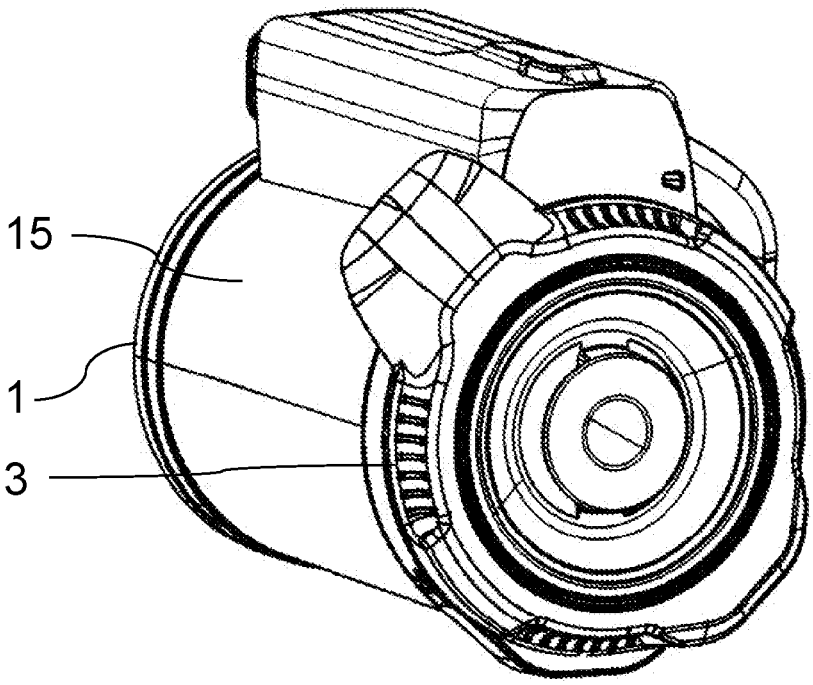
FIG. 6 a perspective view of the suction container and operating element shown in FIG. 1.

FIG. 6 shows a perspective view of the suction container and operating element shown in FIG. 1. As can be seen from a comparison of FIGS. 1 and 6, the operating element 3 can be rotated from the second position shown in FIG. 1 into a third position.

Figure 7:
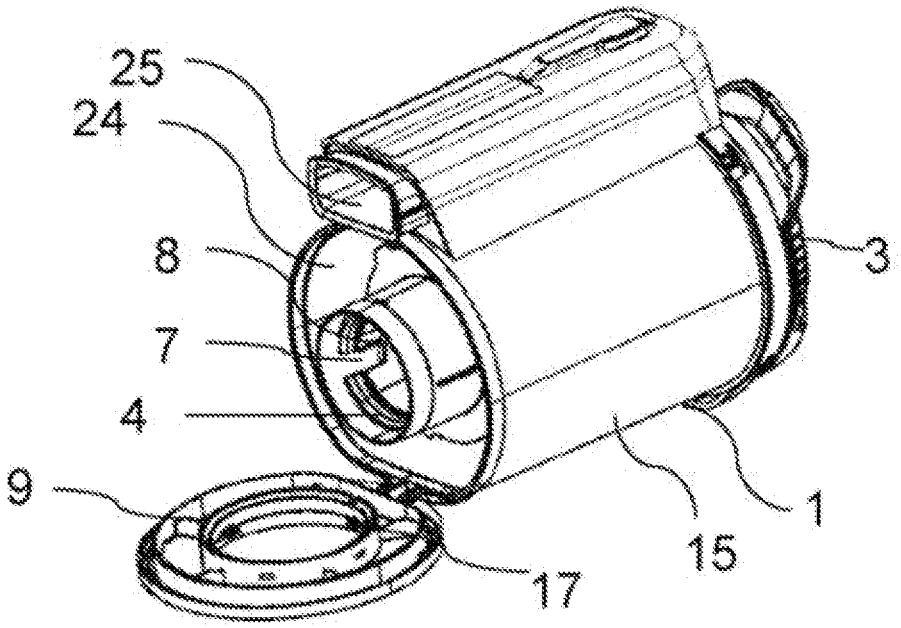
FIG. 7 a further perspective view of the suction container and operating element shown in FIG. 6.

FIG. 7 shows a further perspective view of the suction container and operating element shown in FIG. 6. As can be seen from a comparison of FIGS. 6 and 7, the operating element is in the third position. In the third position, the flap 9 is open. It is arranged on the housing 15 in a pivotable manner. The suction container 1 has the suction collection chamber 24 which is designed to collect suction material and which can be emptied in the third position of the operating element 3 by opening the flap 9. The suction container 1 has an air duct 25 through which the suction stream flows during operation. During operation, the suction stream first flows through the suction channel of the device body shown in FIGS. 1 and 2, then through the air duct 25 shown in FIG. 7, subsequently through an area not shown of the suction container 1, then through the pre-filter shown in FIGS. 4 and 5, then, as gas stream purified from suction material, through an exhaust-air duct 8 and then through a duct formed in the connecting piece of the device body shown in FIGS. 1 and 2 into the device body. The flap 9 has flap latching cams 17. In the third position of the operating element 3, these latching cams 17 lie above a recess of the locking geometry 7 of the pre-filter 4.

Figure 8:
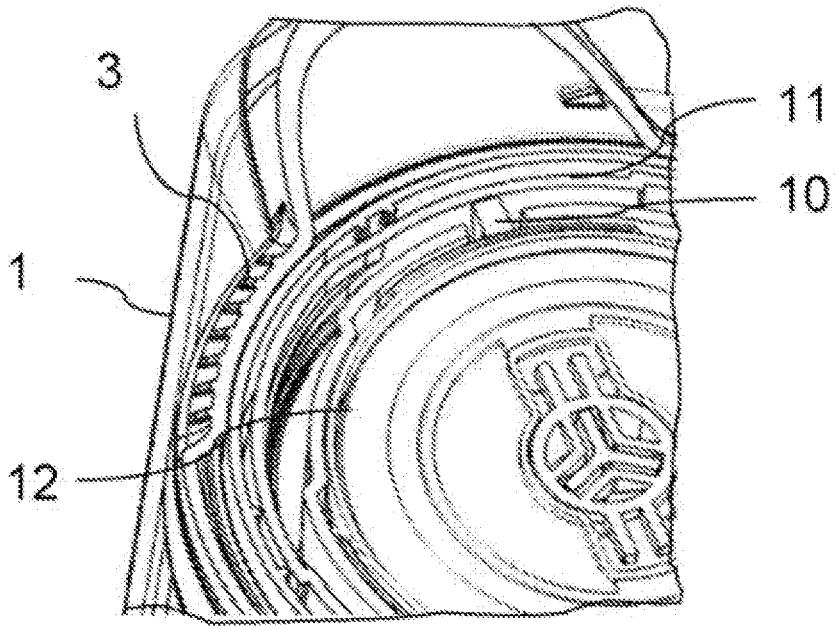
FIG. 8 a partial perspective view of the suction container and operating element shown in FIG. 2.

FIG. 8 shows a partial perspective view of the suction container and operating element shown in FIG. 2. The central filter 12 is arranged concentrically in the pre-filter. The suction container 1 has latching hooks 10 which are designed in such a way that they are free of force if the operating element 3 is in a position other than in the fourth position. So that the central filter 12 can be pulled out of the housing 15, which is shown in FIG. 2, in the fourth position, they are designed such that they bounce up briefly but then spring back if the operating element 3 is in the fourth position, which is not shown in FIG. 9. Due to a geometry of a centering ring 11, the bouncing up of the latching hooks 10 is blocked until the operating element 3 is in the fourth position.

Figure 9:
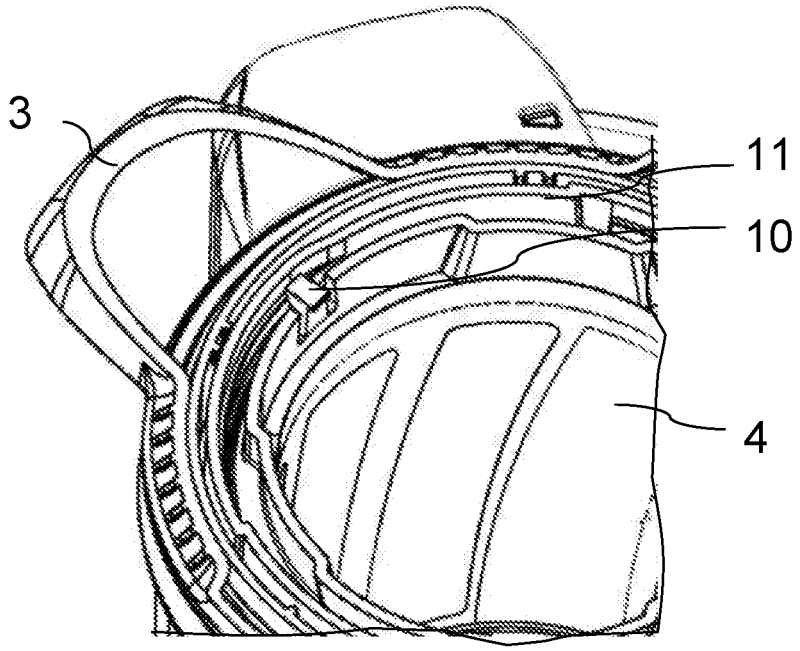
FIG. 9 a further partial perspective view of the suction container and operating element shown in FIG. 8.

FIG. 9 shows a further partial perspective view of the suction container and operating element shown in FIG. 8. The operating element 3 is in the fourth position. In the fourth position of the operating element 3, the central filter shown in FIG. 8 can be removed from the housing 15 and is also removed in this FIG. 9. The spring travel for the latching hooks 10, which are arranged on the pre-filter 4 and which are designed in such a way that the central filter can be removed from the housing 15 if the operating element 3 is in the fourth position, is unblocked.

Figure 10:
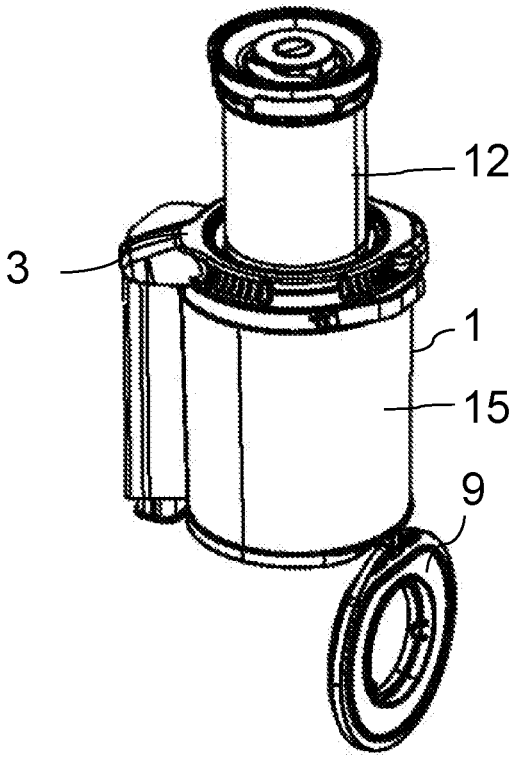
FIG. 10 a further perspective view of the suction container shown in FIGS. 8 and 9.

FIG. 10 shows a further perspective view of the suction container shown in FIGS. 8 and 9. The operating element 3 is in the fourth position. The central filter 12 is removable from the housing 15. The flap 9 is open.

Figure 11:
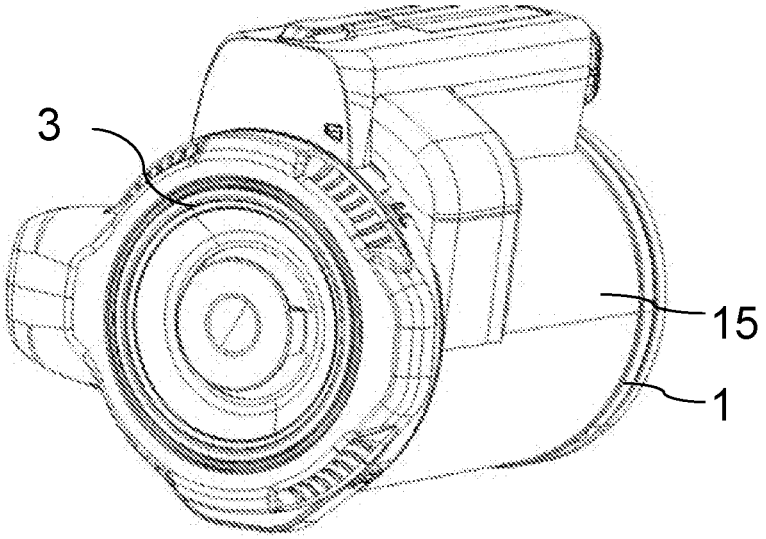
FIG. 11 a further perspective view of the suction container and operating element shown in FIG. 2.

FIG. 11 shows a further perspective view of the suction container and operating element shown in FIG. 2. As can be seen from a comparison of FIGS. 1, 2, 6, 8 and 11, the operating element 3 can be rotated into a fifth position.

Figure 12:
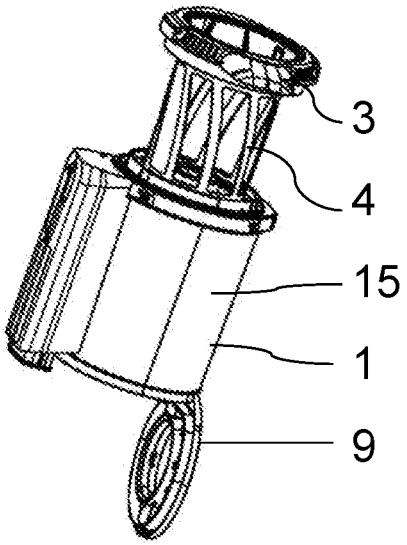
FIG. 12 a further perspective view of the suction container shown in FIG. 11.

FIG. 12 shows a further perspective view of the suction container shown in FIG. 11. The operating element 3 is arranged in the fifth position and can be removed together with the pre-filter 4 from the housing 15. The flap 9 is open.

Figure 13:
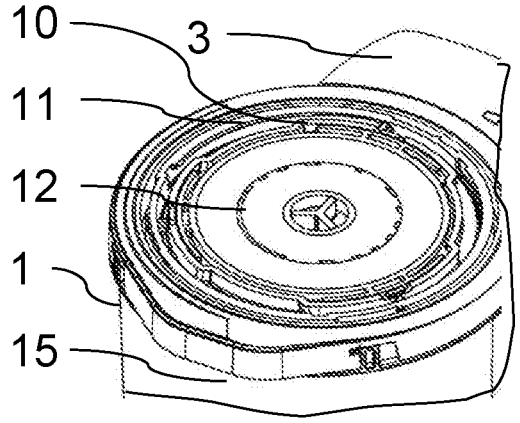
FIG. 13 a further perspective view of the suction container and operating element shown in FIG. 2.

FIG. 13 shows a further perspective view of the suction container and operating element shown in FIG. 2. The operating element 3 is arranged in the fifth position. The central filter 12 is arranged in the housing 15. The central filter 12 can but does not have to be removed in the fourth position of the operating element 3 shown in FIG. 10 before the operating element 3 is rotated into the fifth position. In the fifth position of the operating element 3, the operating element 3 can be separated together with the pre-filter and the central filter 12 from the housing 15.

Figure 14:
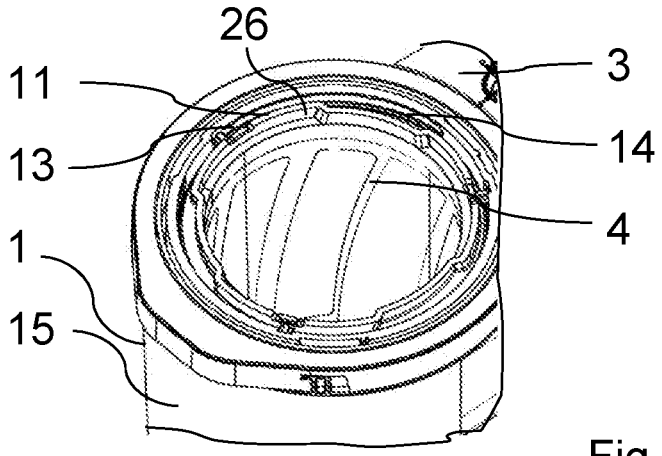
FIG. 14 a further perspective view of the suction container shown in FIG. 12.

FIG. 14 shows a further perspective view of the suction container shown in FIG. 12. In order to ensure that the pre-filter 4 is removed, the pre-filter has transverse ribs 13 which are arranged and distributed over the circumference. The transverse ribs 13 serve as guide elements when rotating the operating element 3. The transverse ribs 13 run in grooves 26 of the centering ring 11 which are designed such that they have an opening in the perpendicular direction in the fifth position of the operating element 3. If the operating element 3 is in the fifth position, it can be removed perpendicularly to the axis of rotation. Individual positions of the operating element 3 are released via latching points 14 which are located in the centering ring 11. In order to get from the first to the second, from the second to the third, from the fourth to the fifth position, a latching point 14 with the transverse ribs 13 must be overcome in each case.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Suction container
2 Device body
3 Operating element
4 Pre-filter
5 Connecting piece
6 Latching cams
7 Locking geometry
8 Exhaust-air duct
9 Flap
10 Latching hook
11 Centering ring
12 Central filter
13 Transverse ribs
14 Latching points
15 Housing
16 Base plate
17 Flap latching cam
18 Suction channel
19 Handle
20 Suction pipe
21 Wall
22 Slot
23 Locking part
24 Collection chamber
25 Air duct
26 Groove

What is claimed is:

1. A hand-guide cyclone vacuum cleaner, comprising:

a device body which has a drive unit configured to generate a suction air flow;

a suction container, which is connected to the device body, configured to receive suction material; and an operating element arranged at one end of the suction container opposite an end of the suction container on which the device body is arranged, wherein the operating element is rotatable about a rotational axis and along a circumference from a first position into a second position and from the second position into the first position, wherein the device body is inseparably connected to the suction container in the first position, wherein the device body is separably connected to the suction container in the second position, wherein the suction container has a housing, a pre-filter being arranged in the housing, a central filter arranged in the pre-filter and a flap, which is arranged at the end of the suction container, on which the device body is arranged, wherein the operating element is rotatable about the rotational axis and along the circumference into third, fourth, and fifth positions and vice versa, and wherein the flap is openable in the third position, the central filter is removable from the pre-filter in the fourth position, and the pre-filter is removable from the housing in the fifth position.

2. The vacuum cleaner according to claim 1, wherein the device body has a base plate and a connecting piece which extends away from the base plate and comprises a latching cam, and wherein the suction container has a pre-filter with a locking geometry, which is configured such that it holds the latching cam in the first position of the operating element and releases it in the second position of the operating element, so that the device body is non-removably connected to the suction container in the first position of the operating element and is removably connected to the suction container in the second position.

3. The vacuum cleaner according to claim 1, wherein the latching cam is arranged to be adjacent to a stop of the locking geometry in the second position so that, when the operating element rotates from the first position into the second position, rotation of the operating element beyond the second position into the third position is prevented as long as the suction container is arranged on the device body.

4. The vacuum cleaner according to claim 1, wherein the flap has a flap latching cam which engages in the locking geometry of the pre-filter in the second position of the operating element and is configured such that it lies above a recess in the locking geometry of the pre-filter when the suction container is separated from the device body and the operating element is rotated into the third position, so that the flap is pivotable.

5. The vacuum cleaner according to claim 4, wherein the suction container comprises a spring which is configured to pivot the flap away from the housing and the pre-filter in the third position of the operating element.

6. The vacuum cleaner according to claim 1, wherein the suction container comprises a latching hook which is arranged on the pre-filter and which holds the central filter in the pre-filter and which is configured such that it is free of force in an operating state and is released for a spring travel once the operating element is rotated into the fourth position, so that the central filter is removable from the pre-filter.

7. The vacuum cleaner according to claim 1, wherein the pre-filter has at least three transverse ribs and the operating element has a centering ring with grooves in which the transverse ribs run, and wherein the grooves are configured such that they each have an opening in the fifth position so that the operating element together with the pre-filter is removable perpendicularly to an axis of rotation.

8. The vacuum cleaner according to claim 7, wherein the centering ring has latching points which can be overcome by the transverse ribs during rotation in order to get from one position into a next position of the first, second, third, fourth, and fifth positions during the rotation.

9. The vacuum cleaner according to claim 1, wherein the operating element is configured such that it is rotated by 20-25° from the first position into the second position, by 42-45° from the first position into the third position, by 77-80° from the first position into the fourth position, and by 88-90° from the first position into the fifth position.

* * * * *